US005878600A

United States Patent [19]

Yeo et al.

[11] Patent Number: 5,878,600

[45] Date of Patent: Mar. 9, 1999

[54] APPARATUS FOR GENERATING AN UPWARD WATER JET IN A CLOTHES WASHER

[75] Inventors: Jong-Hoon Yeo, Suwon; Jin-Sung Hwang, Yongin-gun, both of Rep. of Korea

[73] Assignee: Samsung Electronics Co., Ltd., Suwon, Rep. of Korea

[21] Appl. No.: 805,349

[22] Filed: Feb. 24, 1997

[30] Foreign Application Priority Data

Feb. 27, 1996 [KR] Rep. of Korea ..... 1996-3239
Jul. 20, 1996 [KR] Rep. of Korea ..... 1996-29475

[51] Int. Cl.[6] ..... D06F 39/08

[52] U.S. Cl. ..... 68/23.5; 68/53; 68/184; 68/134

[58] Field of Search ..... 68/207, 208, 184, 68/53, 23.5, 133, 134

[56] References Cited

U.S. PATENT DOCUMENTS

| | | | |
|---|---|---|---|
| 2,021,097 | 11/1935 | Maus | 68/53 |
| 2,299,495 | 10/1942 | Rocke | 68/53 |
| 2,873,600 | 2/1959 | Demaret | 68/207 |
| 2,882,706 | 4/1959 | Bruken | 68/23.5 |
| 4,622,708 | 11/1986 | Gaelic | 68/53 |
| 4,653,294 | 3/1987 | Akinaga | 68/207 |
| 5,199,281 | 4/1993 | Singh et al. | 68/207 |

FOREIGN PATENT DOCUMENTS

| | | | |
|---|---|---|---|
| 195880 | 2/1958 | Germany | 68/53 |
| 198224 | 6/1958 | Germany | 68/53 |
| 1091975 | 11/1960 | Germany | 68/207 |
| 61-191398 | 8/1986 | Japan | 68/207 |
| 64-11593 | 1/1989 | Japan | 68/134 |
| 64-2689 | 1/1989 | Japan | 68/53 |
| 290861 | 5/1953 | Switzerland | 68/53 |
| WO93/13257 | 7/1993 | WIPO | 68/134 |

*Primary Examiner*—Frankie L. Stinson
*Attorney, Agent, or Firm*—Burns, Doane, Swecker & Mathis, L.L.P.

[57] ABSTRACT

A clothes washing machine includes a spin-dry tub and an oscillatory agitator disposed at the bottom of the tub. The agitator includes a centrally located vertical hole in which an axial fan is mounted. A drive mechanism oscillates the axial fan relative to the agitator about a vertical axis to generate an upward water jet that disperses the laundry in a manner preventing entwinement and entanglement thereof. The driving mechanism comprises a roller mounted on an underside of the agitator. The roller engages the bottom of the tub and is oscillated by frictional contact therewith during oscillation of the agitator. Oscillation of the roller is transmitted to the axial fan by a flexible shaft.

22 Claims, 9 Drawing Sheets

APPARATUS FOR GENERATING AN UPWARD WATER JET IN A CLOTHES WASHER

BACKGROUND OF THE INVENTION

1. Field of the Invention

The present invention relates to a clothes washing machine which agitates the laundry by forward and reverse rotations of a pulsator.

2. Description of the Prior Art

As shown in FIG. 1, a conventional clothes washing machine includes a washing tub 20 fixedly disposed in a body 10 of the washing machine, a motor 30 arranged under the washing tub 20, and power transmission means 50 installed under a middle portion of the washing tub 20 which receives a drive power of the motor 30 through a belt 40 and then transmits it to a spin-drying tub 60 or a pulsator (agitator) 70.

The spin-drying tub 60 for spin-drying the laundry by way of centrifugal force generated by the motor 30 is mounted at the end of the power transmission means 50 within the washing tub 20. The pulsator 70 is rotatably disposed at an inner bottom of the spin-drying tub 60, and the pulsator 70 repeats forward and reverse rotations (i.e., oscillates) according to the power of the power transmission means 50. That oscillation disturbs a water current in the spin-drying tub 60, and simultaneously agitates the laundry thereby carrying out the washing.

As shown in FIG. 2, a plurality of vanes 73 radially protrude from an upper surface of the pulsator 70 at regular intervals with a central shaft 72 formed at a center of the pulsator 70 so as to disturb the water current and at the same time agitate the laundry during washing and rinsing steps.

In addition, water supply means 80 for supplying the washing water into the spin-drying tub 60 is disposed at a rear of the body 10 of the washing machine.

The washing tub 20 is provided at a bottom area thereof with drainage means 90 for draining out the washing water within the spin-drying tub 60.

As shown in FIG. 1, the water supply means 80 is provided at a bottom area thereof with detergent dissolution means 100 for dissolving detergent therein by supplied water and for supplying the dissolved detergent solution into the washing tub 20 and the spin-drying tub 60.

However, there is a problem in the conventional washing machine thus constructed, in that the plurality of vanes 73 produce a water current shown in FIG. 3 which causes the laundry to be entwined and entwisted when the pulsator 70 oscillates during the washing and rinsing steps.

The entwinement and entwistment of the laundry cause reduction of washing and rising efficiencies in the washing machine.

SUMMARY OF THE INVENTION

Accordingly, the present invention is disclosed to overcome the above-mentioned disadvantages, and it is an object of the present invention to provide an apparatus for injecting central water currents in a washing machine in which an axial flow fan oscillates and ejects a washing water upwards from a central area of a pulsator (agitator) by oscillation of a fan driving unit disposed between the lower surface of the pulsator and a bottom surface of a spin-drying tub during the oscillation of the pulsator, thereby dispersing the laundry, preventing the entwinement and entwistment of the laundry, and improving the washing and rising efficiencies.

In accordance with the object of the present invention, there is provided an apparatus for injecting central water currents in a washing machine, the apparatus comprising:

an axial flow fan disposed within a through hole of agitating means which oscillates along with the agitating means and forms water currents jetted toward a central upper portion of the agitating means; and a fan driving unit disposed at one side of the lower surface of the agitating means which rotates the axial flow fan through a turning effect generated by friction with a bottom surface of a spin-drying tub according to rotation of the agitating means.

DESCRIPTION OF THE PREFERRED EMBODIMENTS

Figure 1:
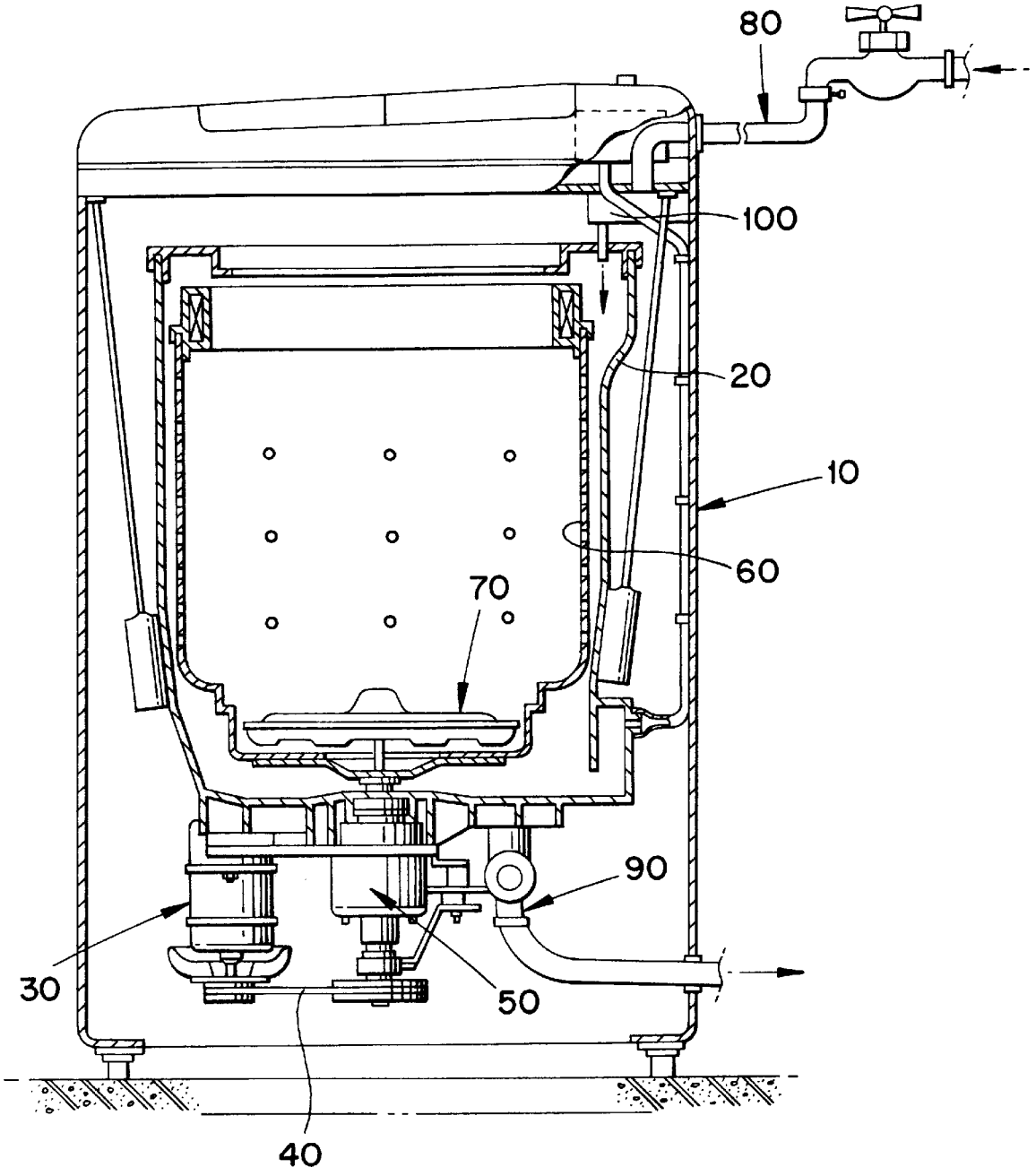
FIG. 1 (PRIOR ART)
FIG. 1 is a longitudinal sectional view for illustrating a conventional washing machine.
Figure 2:
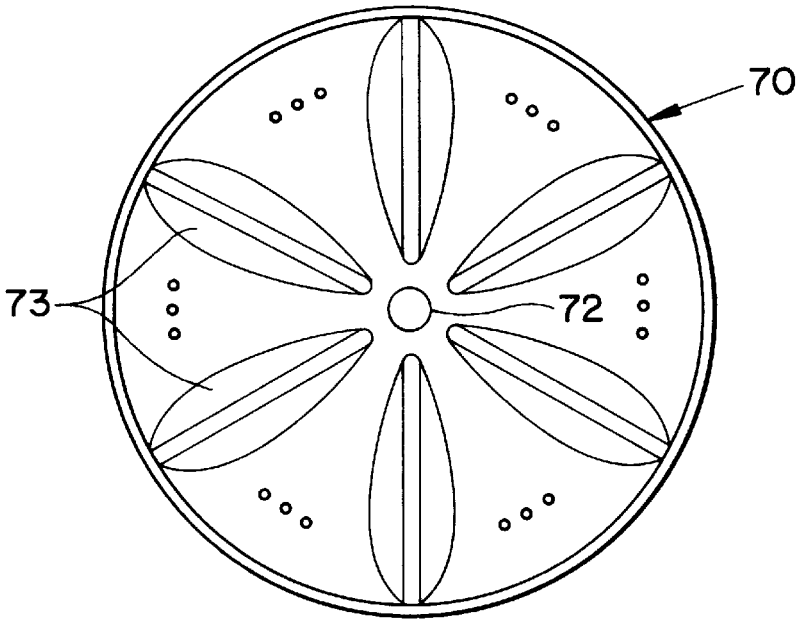
FIG. 2 (PRIOR ART)
FIG. 2 is a plan view for illustrating a pulsator of the conventional washing machine.
Figure 3:
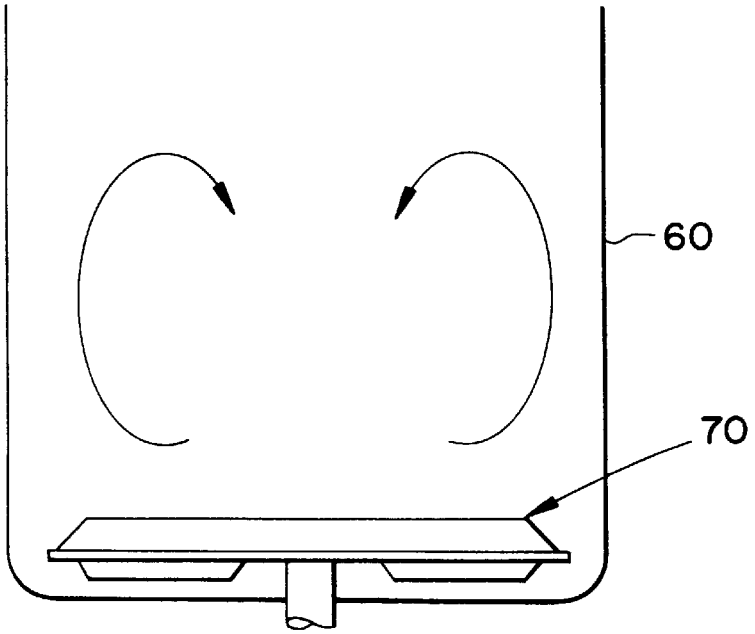
FIG. 3 (PRIOR ART)
FIG. 3 is a schematic diagram for illustrating water currents formed by the pulsator of the conventional washing machine.

The first embodiment of the present invention will now be described in detail with reference to FIGS. 4 through 8. Throughout the drawings, like terms and reference numerals are used for designation of like or equivalent parts or portions as in FIGS. 1 through 3 and redundant references will be omitted for simplicity of illustration and explanation.

Figure 4:
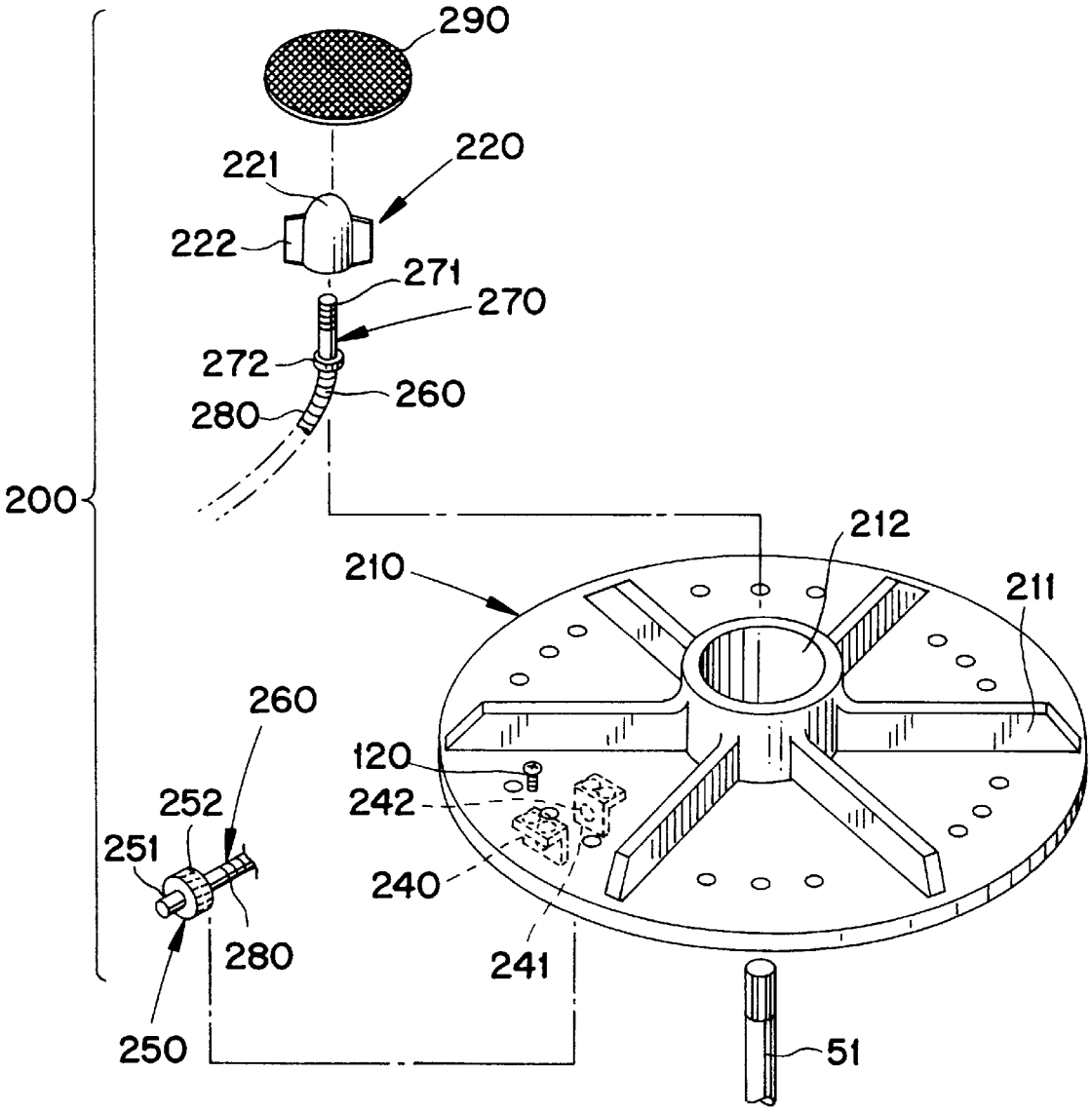
FIG. 4 is an exploded perspective view for illustrating central water current injection means and a pulsator according to a first embodiment of the present invention.
Figure 5:
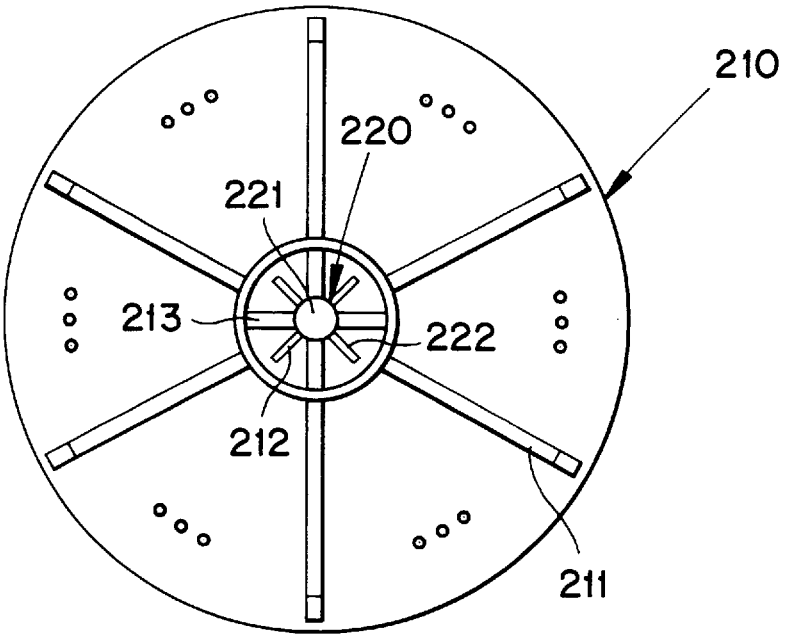
FIG. 5 is a top plan view (with filter removed) for showing the central water current injection means and the pulsator of FIG. 4.

FIG. 4 shows a pulsator (agitator) 210 which creates disturbed water currents, and a central water current injection means 200 which disperses the laundry by a central jet water current when the pulsator 210 repeats forward and reverse rotations (i.e., oscillates) during the washing and rinsing steps so as to prevent the entwinement and entwistment of the laundry.

Figure 6:
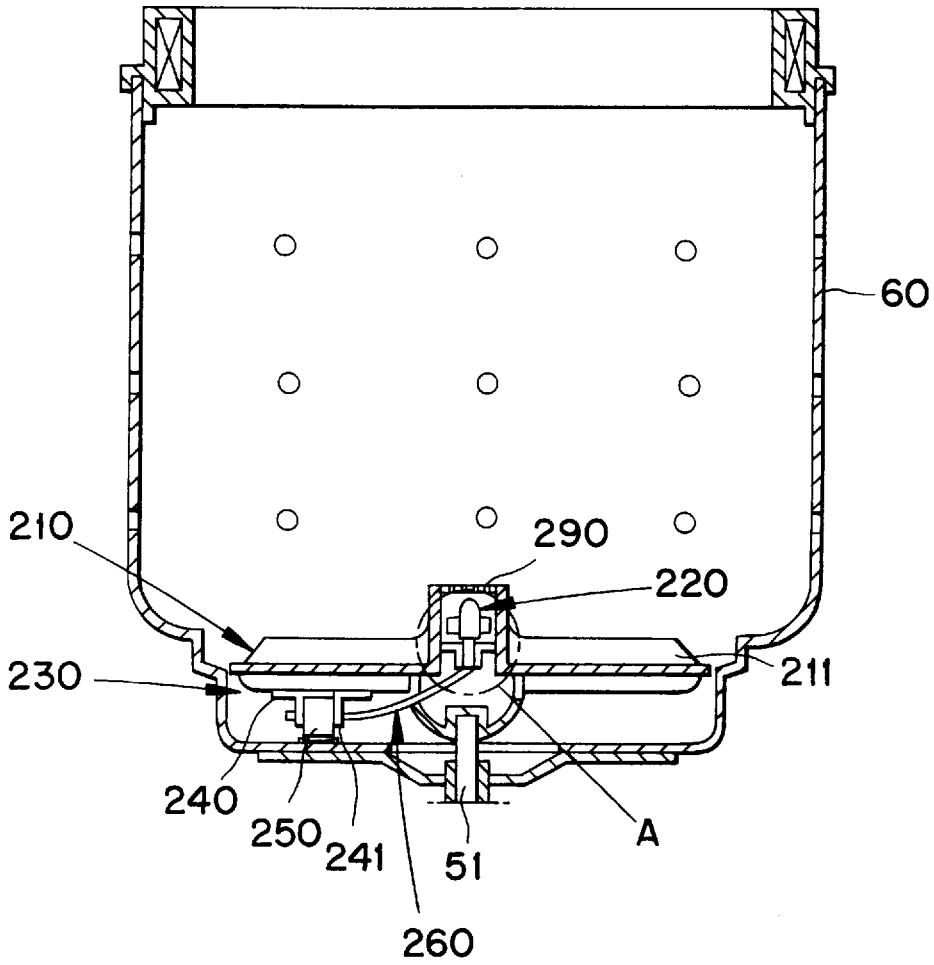
FIG. 6 is a longitudinal sectional view for illustrating the central water current injection means and the pulsator of FIG. 4.

As shown in FIG.6 the central water current injection means 200 comprises an axial flow fan 220, disposed within the pulsator 210, which rotates (oscillates) simultaneously with the forward and reverse rotations (oscillation) of the pulsator 210 and forms water currents jetted toward a central upper portion of the pulsator 210 so as to prevent the entwinement and entwistment of the laundry. A fan driving unit 230 is disposed on one side of the lower surface of the pulsator 210, which rotates the axial flow fan 220 through a turning effect generated by friction with a bottom surface of a spin-drying tub 60 during the rotation of the pulsator 210.

Figure 7:
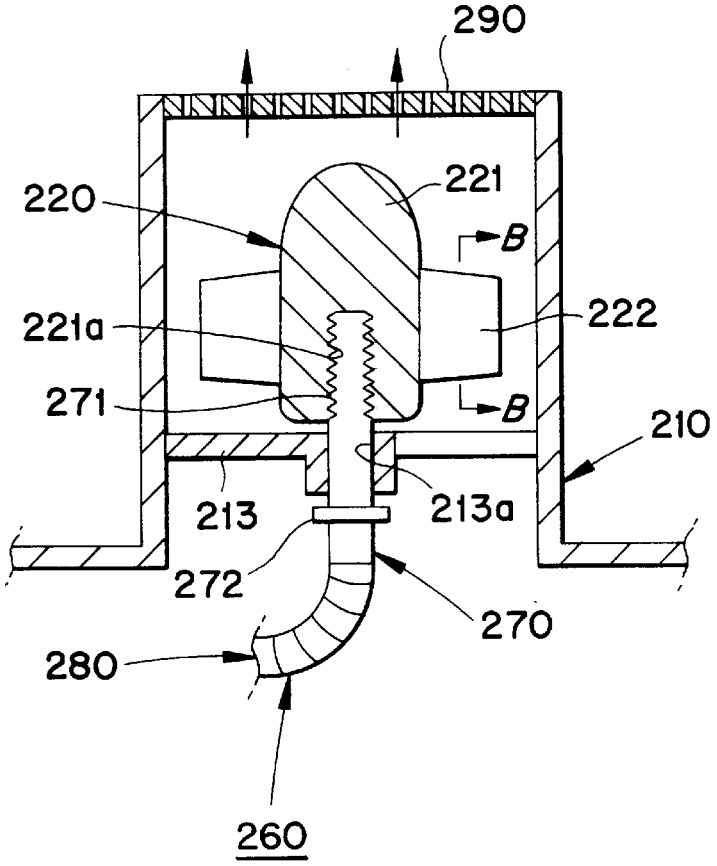
FIG. 7 is an enlarged sectional view of portion A in FIG. 6.

A plurality of radial pulsator vanes 211 protrude upwardly from the upper surface of the pulsator 210 at regular intervals, and a through hole 212 formed at the center of the pulsator 210 allows the axial flow fan 220 to be installed and the water currents to be circulated. As shown in FIG.7, a support member 213 having an axial hole 213*a* for supporting the axial flow fan 220 is disposed within the through hole 212.

The axial flow fan 220 comprises a fan body 221 having a female screw 221*a* which is installed within the through hole 212 formed at the center of the pulsator 210, and a plurality of fan blades 222 protruding radially on the outer circumferential surface of the fan body 221 at regular intervals so as to form water currents jetted from the lower portion to the upper portion of the through hole 212 of the pulsator 210.

Figure 8:
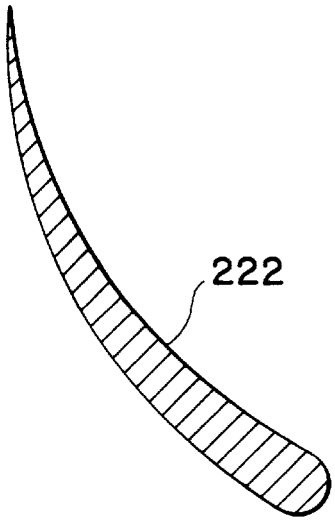
FIG. 8 is sectional view taken along line B—B of FIG. 7.

As shown in FIG. 8, the fan blades 222 have curved wedge-shaped cross sections.

As shown in FIGS. 4 and 6, the fan driving unit 230 includes an outer support member 240 and an inner support member 241, a roller member 250, and a connection member 260. The outer support member 240 and the inner support member 241 are attached at one side of the lower surface of the pulsator 210 at a predetermined interval by a plurality of fastening bolts 120, respectively. The roller member 250 is rotatably disposed between the outer support member 240 and the inner support member 241, so that the roller member 250 rotates simultaneously with the rotation of the pulsator 210 and rolls by means of friction against the bottom surface of the spin-drying tub 60. The connection member 260 connects the roller member 250 to the axial flow fan 220, and rotates flexibly according to the rotation of the roller member 250 at the same time, thereby rotating the axial flow fan 220 at a higher rotation speed than that of the pulsator 210.

A roller axle 251 is integrally protruding from the center of both sides of the roller member 250 and is rotatably inserted into symmetrical roller holes 242 formed in the outer and inner support members 240 and 241, and a plurality of embossments 252 are formed on the outer circumferential surface of the roller member 250 so as to increase friction with the bottom surface of the spin-drying tub 60.

The connection member 260 comprises a terminal connection axle 270 protruding from the bottom of the axial hole 213*a* formed at the center of the support member 213 and screwed into the female screw 221*a* formed in the fan body 221 of the axial flow fan 220. The member 260 also includes a connection shaft 280 the ends of which are connected respectively to the terminal connection axle 270 and the roller axle 251 of the roller member 250.

A male screw 271 is formed at the upper end of the terminal connection axle 270 and is screwed into the female screw 221a formed in the fan body 221 of the axial flow fan 220. A protrusion 272 is formed on the outer circumferential surface of the lower portion of the terminal connection axle 270 so that the terminal connection axis 270 is not detached from the through hole 212 of the pulsator 210 when the axial flow fan 220 rotates.

The central connection shaft 280 can be made of an elastic steel, a stainless steel, or a plastic material, and the stainless steel is preferable in order to prevent the possibility of corrosion.

A filtering member 290 is disposed at the upper end of the through hole 212 of the pulsator 210 in order to remove any foreign particles included in the water currents and simultaneously to protect the axial flow fan 220 from any foreign particles and the laundry.

The operation and effect according to the first embodiment of the present invention will be hereinafter described in detail.

During a washing process, the laundry, detergent and washing water are inserted into the spin-drying tub 60. The washing shaft 51 and the pulsator 210 are rotated (oscillated) in the forward and reverse direction, and then the pulsator vanes 211 arranged radially on the upper surface of the pulsator 210 form water currents traveling upward then towards the center of the spin-drying tub 60 as shown by outside arrows of FIG. 12.

When the pulsator 210 rotates, the roller member 250 attached to the lower surface of the pulsator 210 rotates by means of friction with the bottom surface of the spin-drying tub 60. The rotation of the rolling member 250 rotates (oscillates) the axial flow fan 220 installed within the through hole 212 of the pulsator 210 in the forward and reverse directions through the connection member 260 connected to the roller axle 251. At this time, the axial flow fan 220 rotates forward and reverse at a higher speed than that of the pulsator 210.

Figure 12:
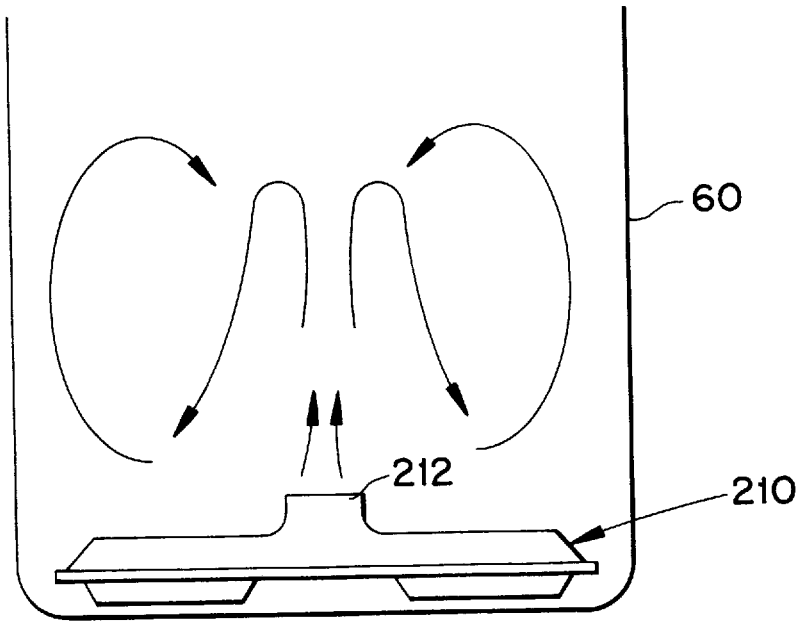
FIG. 12 is a schematic diagram for illustrating water currents formed by the central water current injection means according to the first and second embodiments of the present invention.

The plural fan blades 222 arranged radially around the fan body 221 of the axial flow fan 220 form central water currents jetted from the central lower side to the upper side of the spin-drying tub 60 as shown by central arrows of FIG. 12, so that the laundry os dispersed by the collision with the water currents thereby preventing the entwinement and entwistment of the laundry.

At this time, the filtering member 290 disposed at the upper end of the through hole 212 of the pulsator 210 prevents the laundry and the foreign particles included in the washing water from flowing into the axial flow fan 220 through the through hole 212 during the washing and rinsing processes. The plural fan blades 222 of the axial flow fan 220 jets the washing water to the central upper portion powerfully, and the jet water currents collide against the laundry with force.

After the washing process is finished, the washing water is drained through a drainage means 90 connected to the bottom of the washing tub 20.

During the rinsing process, a valve of the drainage means 90 is closed and simultaneously a rinsing water is supplied into the washing tub 20 and spin-drying tub 60 by way of water supply means 80. At this time, the pulsator 210 and the axial flow fan 220 disturb the rinsing water by the same operation as the aforementioned washing process, thereby reducing the required rinsing time and the necessary amount of the rinsing water.

After the rinsing process is finished, the rinsing water is drained through drainage means 90 connected to the bottom of the washing tub 20.

During the spin-drying process, a spin-drying shaft (not shown) of power transmission means 50 rotates the spin-drying tub 60 at a high speed for several seconds consecutively, thereby removing the residual rinsing water in the laundry.

As described above, according to the first embodiment of the present invention, the dispersion of the laundry is increased, the entwinement and entwistment of the laundry is prevented, and the washing efficiency is improved.

The second embodiment of the present invention will now be described in detail with reference to FIGS. 9 through 11. Throughout the drawings, like terms and reference numerals are used for designation of like or equivalent parts or portions as in FIGS. 4 through 8 and redundant references will be omitted for simplicity of illustration and explanation.

Figure 9:
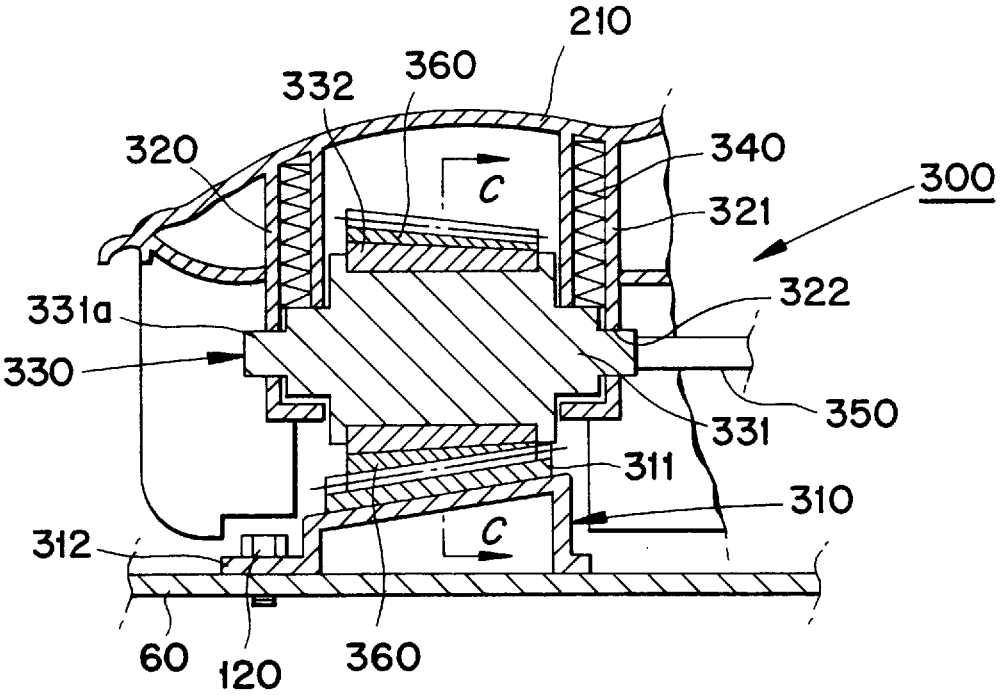
FIG. 9 is a fragmentary sectional view for illustrating a fan driving unit according to a second embodiment of the present invention.

In FIG. 9, reference numeral 300 is a fan driving unit disposed between the pulsator 210 and the spin-drying tub 60 which transmits a stable power to the axial flow fan 220 in a positive manner and minimizes noise.

As shown in FIG. 9, the fan driving unit 300 comprises a guide member 310 fixed to the bottom surface of the spin-drying tub 60 by means of a plurality of fastening bolts 120, and outer and inner support members 320 and 321 mounted vertically at one side of the lower surface of the pulsator 210 at a predetermined interval, a rotation member 330 joined by teeth to the guide member 310 and disposed rotatably between the outer support member 320 and the inner support member 321 so as to rotate along the guide member 310 and to move simultaneously according to the rotation of the pulsator 210. Elastic members 340 are installed within the outer and inner support members 320 and 321 which push the rotation member 330 by an elastic force so that the rotation member 330 can be stably joined to the guide member 310. A connection member 350 connects the rotation member 330 to the axial flow fan 220, and rotates flexibly according to the rotation of the rotation member 330 at the same time, thereby rotating the axial flow fan 220 at a higher rotation speed than that of the pulsator 210.

Figure 10:
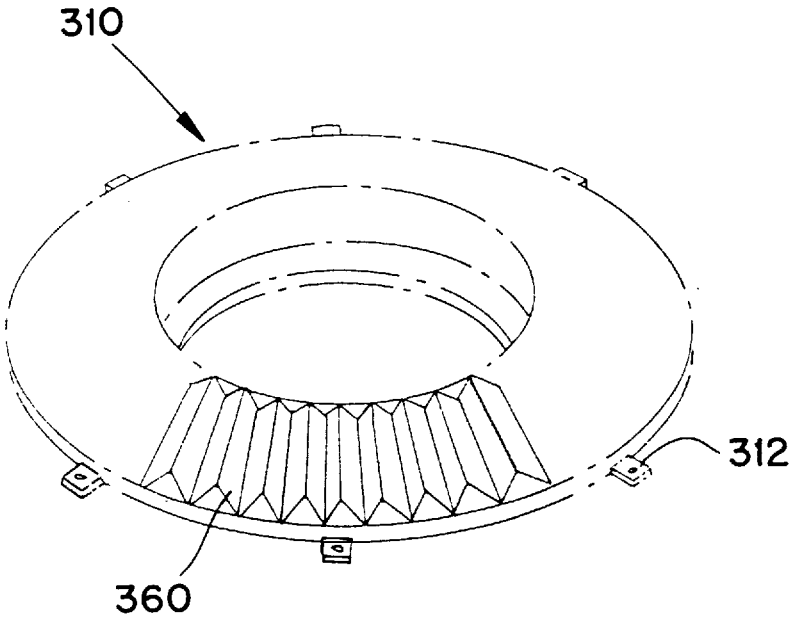
FIG. 10 is a perspective view for illustrating a guide member according to the second embodiment of the present invention.
Figure 11:
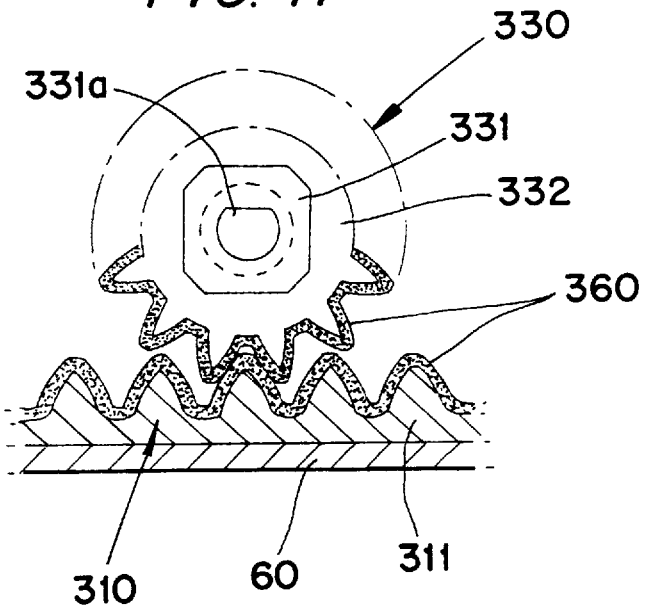
FIG. 11 is a sectional view taken along line C—C of FIG. 9.

As shown in FIG. 10, the guide member 310 is a circular ring shaped rack 311 formed on the upper surface of the guide member 310 so that the rotation member 330 can be meshed with the rack 311, and a plurality of flanges 312 are integrally formed at predetermined positions on the outer circumferential surface of the guide member 310, so that plural fastening bolts 120 can be screwed through the flanges 312 into the bottom of the spin-drying tub 60.

The rotation member 330 includes a roller 331 having a roller axle 331*a* protruding from both sides thereof which is rotatably inserted into insertion holes 322 formed in the outer and inner support members 320 and 321, and a pinion 332 formed on the outer circumferential surface of the roller 331 which is meshed with the rack 311 of the guide member 310.

The pinion 332 and rack have an inclination relative to horizontal as shown in FIG. 9.

Contact portions of the rack 311 and the pinion 332 are coated with a friction reducing substance 360 made of polyester elastomer so as to minimize friction noise generated when the pinion 332 rotates along the rack 311.

Elastic members 340 are coiled compression springs which are inserted into the outer and inner support members 320 and 321.

The operation and effect according to the second embodiment of the present invention will be hereinafter described in detail.

Since the pinion 332 of the rotation member 330 is disposed rotatably in the outer and inner support members 320 and 321 of the fan driving unit 300 and is meshed with the rack 311 of the guide member 310 fixed on the bottom surface of the spin-drying tub 60, the pinion 332 rotates simultaneously according to the forward and reverse rotations of the pulsator 210.

Rotation of the pinion 332 causes the connection member 350 connected to one side of the pinion 332 to rotate, and then the connection member 350 rotates the axial flow fan 220 in forward and reverse directions at a higher speed than that of the pulsator 210.

At this time, the axial flow fan 229 forms central water currents jetted from the central lower side to the upper side of the spin-drying tub 60 as shown by the central arrows of FIG. 12, so that the laundry is dispersed by the collision with the water currents thereby preventing the entwinement and entwistment of the laundry.

Since the contact portions of the rack 311 and the pinion 332 are coated with the friction reducing substance 360, the friction noise can be minimized when the pinion 332 rotates along the rack 311.

Since the pinion 332 is rotatably inserted into the outer and the inner support members 320 and 321, and is stably meshed with the rack 311 by the elastic force of the elastic member 340 pushing the pinion 332, the pinion 332 will not run off the rack 311, and the rotation force of the pinion 332 is stably transmitted through the connection member 350 to the axial flow fan 220.

As described above, according to the second embodiment of the present invention, since the fan driving unit is installed between the pulsator and the spin-drying tub, and transmits the power through the rack and pinion in order that the pulsator and the axial flow fan can be rotated simultaneously during the washing and the rinsing processes, the power is stably transmitted to the axial flow fan and the friction noise can be minimized.

Having described specific present embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A clothes washing machine comprising:

a tub;

an agitator disposed at the bottom of the tub and mounted for oscillation about a vertical axis to agitate wash water in the tub, the agitator having a vertical hole formed along the axis;

a motor connected to the agitator for oscillating the agitator;

an axial flow fan disposed in the hole and mounted to the agitator for oscillation relative thereto to create an upward current in the wash water; and a driving mechanism for oscillating the axial fan, comprising:

a rotary member mounted on an underside of the agitator for oscillation therewith and being rotatable relative the agitator, the rotary member engaging a bottom surface of the tub to be rotated relative to the agitator by frictional contact with the bottom surface, and a connector connecting the rotary member with the axial fan for transmitting rotation of the rotary member to the axial fan.

2. The clothes washing machine according to claim 1 wherein a support member is disposed in the hole, the support member including a vertical hole for rotatably mounting the axial fan.

3. The clothes washing machine according to claim 1 wherein the axial fan comprises a body having a female screw thread connected to a male screw thread of the connector, and a plurality of fan blades protruding radially from the body.

4. The clothes washing machine according to claim 3, wherein the blades have curved wedged-shaped cross sections.

5. the clothes washing machine according to claim 1 wherein the driving mechanism further comprises two support members fixed to the underside of the agitator, the rotary member disposed between the support members and rotatably mounted thereto, the connector comprising a flexible shaft, the rotary member arranged to rotate the axial fan at a higher speed than that of the agitator.

6. The clothes washing machine according to claim 5 wherein the rotary member carries axles rotatably received in holes formed in respective support members.

7. The clothes washing machine according to claim 5 wherein the flexible shaft includes a first end having a screw thread connected to the axial fan, and a second end connected to the rotary member along an axis of rotation thereof.

8. The clothes washing machine according to claim 7 wherein the flexible shaft projects through a horizontal support disposed in the vertical hole of the agitator, the axial fan disposed above the support, the flexible shaft including a radial protrusion disposed below the support for limiting upward movement of the flexible shaft.

9. The clothes washing machine according to claim 7 wherein the flexible shaft is formed of spring steel.

10. The clothes washing machine according to claim 7 wherein the flexible shaft is formed of stainless steel.

11. The clothes washing machine according to claim 7 wherein the flexible shaft is formed of plastic.

12. The clothes washing machine according to claim 1 wherein the rotary member has an outer surface formed with friction-enhancing embossments.

13. The clothes washing machine according to claim 1 further including a filter extending across the vertical hole at an elevation above the axial fan.

14. The clothes washing machine according to claim 1 wherein the bottom surface of the tub engaged by the rotary member comprises a curved toothed rack, the rotary member comprising a toothed pinion meshing with the toothed rack, the connector comprising a flexible shaft.

15. The clothes washing machine according to claim 14 further including a pair of support members fixed to an underside of the agitator, the pinion disposed between the support members and rotatably supported thereby.

16. The clothes washing machine according to claim 14 further including an elastic element biasing the pinion downwardly against the rack.

17. The clothes washing machine according to claim 14 wherein the toothed rack and an outer surface of the pinion are inclined relative to horizontal.

18. The clothes washing machine according to claim 14 wherein the teeth of the rack and pinion have a friction-reducing coating.

19. The clothes washing machine according to claim 18 wherein the coating comprises a polyester elastomer.

20. The clothes washing machine according to claim 1 wherein the driving mechanism includes an elastic element biasing the rotary member against the bottom surface of the tub.

21. The clothes washing machine according to claim 1 wherein the connector comprises a flexible shaft.

22. The clothes washing machine according to claim 1 wherein the rotary member is spaced radially outwardly from a vertical center axis of the agitator and is arranged to oscillate the axial fan relative to the agitator at a speed faster than the oscillation speed of the agitator.

* * * * *